United States Patent [19]

Kindig

[11] Patent Number: 4,753,033

[45] Date of Patent: Jun. 28, 1988

[54] PROCESS FOR PRODUCING A CLEAN HYDROCARBON FUEL FROM HIGH CALCIUM COAL

[75] Inventor: James K. Kindig, Boulder, Colo.

[73] Assignee: Williams Technologies, Inc., Tulsa, Okla.

[21] Appl. No.: 11,447

[22] Filed: Feb. 5, 1987

Related U.S. Application Data

[63] Continuation of Ser. No. 718,023, Mar. 24, 1985, abandoned.

[51] Int. Cl.[4] ..... C10L 9/00

[52] U.S. Cl. ..... 44/620; 44/627

[58] Field of Search ..... 44/1, 1 B, 1 SR

[56] References Cited

U.S. PATENT DOCUMENTS

| | | | |
|---|---|---|---|
| 887,145 | 5/1908 | Stoner | 44/4 |
| 2,205,410 | 6/1940 | Howard | 196/28 |
| 2,320,629 | 6/1943 | Matuszak | 196/10 |
| 2,419,558 | 4/1947 | Gibson | 23/153 |
| 2,808,369 | 10/1957 | Hickey | 202/25 |
| 3,107,148 | 10/1963 | Brooks | 423/483 |
| 3,203,892 | 8/1965 | Kimberlin, Jr. et al. | 208/252 |
| 3,280,211 | 10/1966 | McCaulay | 260/683.48 |
| 3,472,624 | 10/1969 | Ridley | 23/209.9 |
| 3,484,196 | 12/1969 | Cohen et al. | 23/123 |
| 3,511,603 | 5/1970 | Yaws | 23/153 |
| 3,537,817 | 11/1970 | Bachelard | 23/153 |
| 3,825,655 | 7/1974 | Heltaver | 423/483 |
| 3,850,477 | 11/1974 | Aldrich et al. | 299/5 |
| 3,852,430 | 12/1974 | Lienau et al. | 423/481 |

(List continued on next page.)

FOREIGN PATENT DOCUMENTS

| | | |
|---|---|---|
| 8426200 | 3/1983 | Australia . |
| 8431282 | 7/1983 | Australia . |
| 8423325 | 11/1983 | Australia . |
| 760896 | 6/1967 | Canada . |
| 16624 | 3/1980 | European Pat. Off. . |
| 84/04759 | 5/1984 | PCT Int'l Appl. . |

OTHER PUBLICATIONS

Bureau of Mines Report No. 5191, "Coal as a Source of Electrode Carbon in Aluminum Production" (Feb. 1956), p. 7.

"Coal Preparation", The American Institute of Mining Metallurgical and Petroleum Engineers, Inc., 4th Ed., 1979, pp. 1-6, 1-8, 1-34 to 1-36, 4-46, 7-26 to 7-28.

1980 Book of ASTM Standards, Pt. 26, Gaseous Fuels: Coal and Coke: Atmospheric Analysis.

*Primary Examiner*—Andrew H. Metz
*Assistant Examiner*—Helane Myers
*Attorney, Agent, or Firm*—Sheridan, Ross & McIntosh

[57] ABSTRACT

A process for substantially reducing the amount of insoluble fluoride-forming species in a coal feed material comprising slurrying a coal feed with a fluoride acid in the presence of an amount of fluoride-complexing species at least equal to the amount necessary to form tightly-bound complex ions with substantially all free-fluoride-ions in the slurry to produce a leached coal product and a spent leach liquor, and separating the leached coal product from the spent leach liquor. The process produces a clean purified fuel with ash content of less than about 5%, and preferably less than about 1%. Loss of fluorine values by formation of insoluble fluorides is minimized. Alkali metals and alkaline earths are substantially dissolved. The process generally comprises sizing the coal to 10 mm or less, leaching the sized coal with hydrofluoric acid in the presence of a determinable amount of a fluoride-complexing species such as silicon or aluminum, separating the leached coal from the spent leach liquor, and optionally some or all of the following: (a) pre-drying or physically beneficiating feed with high moisture or high mineral matter (ash) content; (b) cleaning the leached coal by washing and/or (c) heat treatment; (d) freeing pyrite (and other heavy minerals) and coal from attached silicates and aluminosilicates and physically separating the freed pyrite; (e) subjecting the leached coal to a second strong acid leach. In the preferred processes, hydrofluoric acid is recovered for recycling.

28 Claims, 4 Drawing Sheets

U.S. PATENT DOCUMENTS

OTHER PUBLICATIONS

H. E. Blake, Jr. et al., "Utilization of Waste Fluosilic Acid", Bureau of Mines Report, Apr. 1971.

| | | | |
|---|---|---|---|
| 3,863,846 | 2/1975 | Keller, Jr. et al. | 241/1 |
| 3,870,237 | 3/1975 | Aldrich | 241/1 |
| 3,918,761 | 11/1975 | Aldrich | 299/5 |
| 3,918,767 | 11/1975 | Aldrich | 175/64 |
| 3,926,575 | 12/1975 | Meyers | 44/1 SR |
| 3,961,030 | 6/1976 | Wiewiorowski et al. | 423/126 |
| 3,993,455 | 11/1976 | Reggel et al. | 44/1 SR |
| 3,998,604 | 12/1976 | Hinkley | 44/1 SR |
| 4,025,459 | 5/1977 | Wristers | 252/429 R |
| 4,032,621 | 6/1977 | Meadows | 423/483 |
| 4,054,421 | 10/1977 | Robinson et al. | 44/1 SR |
| 4,069,296 | 1/1978 | Huang . | |
| 4,071,328 | 1/1978 | Stake | 44/1 R |
| 4,080,176 | 3/1978 | Verschuur | 44/1 SR |
| 4,081,250 | 3/1978 | Hsu et al. | 44/1 SR |
| 4,081,251 | 3/1978 | Colli | 44/1 SR |
| 4,083,940 | 4/1978 | Das | 44/1 SR |
| 4,118,200 | 10/1978 | Kruesi | 44/1 R |
| 4,119,410 | 10/1978 | Kindig et al. | 44/1 SR |
| 4,120,939 | 10/1978 | Ehlig | 423/483 |
| 4,134,737 | 1/1978 | Yang | 44/1 SR |
| 4,163,045 | 7/1979 | Van der Meer et al. | 423/483 |
| 4,169,710 | 10/1979 | Jensen | 44/1 SR |
| 4,173,530 | 11/1979 | Smith et al. | 209/9 |
| 4,178,231 | 12/1979 | Smith et al. | 209/3 |
| 4,178,233 | 7/1981 | Smith et al. | 209/3 |
| 4,192,650 | 3/1980 | Seitzer | 44/1 SR |
| 4,202,757 | 5/1980 | Amendola | 208/10 |
| 4,213,765 | 7/1980 | Wilson | 44/1 SR |
| 4,244,699 | 1/1981 | Smith et al. | 44/1 SR |
| 4,248,698 | 2/1981 | Keller, Jr. | 209/5 |
| 4,249,669 | 2/1981 | Smith et al. | 241/20 |
| 4,252,639 | 2/1981 | Smith et al. | 209/5 |
| 4,260,394 | 4/1981 | Rich | 44/1 SR |
| 4,265,737 | 5/1981 | Smith et al. | 209/3 |
| 4,274,946 | 6/1981 | Smith et al. | 209/5 |
| 4,278,442 | 7/1981 | Matsuda et al. | 44/1 R |
| 4,305,726 | 12/1981 | Brown, Jr. | 44/1 SR |
| 4,324,560 | 4/1982 | Fonuseca | 44/1 SR |
| 4,325,707 | 4/1982 | Kaluinskas et al. | 44/1 SR |
| 4,325,935 | 4/1982 | Krepler | 423/483 |
| 4,355,017 | 10/1982 | Gamson et al. | 423/484 |
| 4,377,391 | 3/1983 | Cotell | 44/1 SR |

PROCESS FOR PRODUCING A CLEAN HYDROCARBON FUEL FROM HIGH CALCIUM COAL

This is a continuation of application Ser. No. 718,023, filed Mar. 24, 1985, now abandoned.

"This Application is related to copending Ser. No. 606,847, filed May 2, 1984 pending, Ser. No. 517,340, filed July 26, 1983, now abandoned, and Ser. No. 517,339, filed July 26, 1983, now abandoned.

FIELD OF INVENTION

This invention relates to processes for producing environmentally acceptable fuels from coal and, in particular, to hydrometallurgical processes for removing contaminants from coal and coal derivatives.

BACKGROUND OF THE INVENTION

Energy demands by the industrialized world are continuing to rise, while the rate of new oil and gas discoveries is falling. Within the next 30 years, available petroleum supplies will fail to meet demand, and oil and gas will no longer be able to serve as the world's major energy source. Other energy sources such as geothermal, solar, and fusion are unlikely to be sufficiently developed to serve as replacements for oil. Coal, on the other hand, exists in relative abundance in the United States, and if it can be adapted to use in existing applications which have been engineered for petroleum use, it can serve as an inexpensive substitute for, and successor to, the more expensive petroleum fuels in use today. In order to be used as a petroleum substitute, however, the coal must be converted to a fluid state, so that systems burning gas, fuel oil, diesel fuel, and other petroleum products can be adapted to its use with minimal equipment modification. The coal also must be cleaned, or purged of its mineral matter (ash precursor) content, including its sulfur (pyrite) content, to eliminate or minimize corrosion, erosion, slagging or fouling of equipment, to minimize the need for post-combustion gas clean-up to meet environmental standards, and to increase fuel value per pound.

U.S. Pat. No. 4,169,710 discloses that treating raw, lump coal with high concentrations of hydrogen fluoride in liquid or gaseous form removes much of the ash content, and this removal of ash from the interstices within the coal tends to cause the coal to break up, so that the hydrogen fluoride also serves as a comminuting agent to produce coal fines.

A major difficulty with previous hydrogen fluoride leach processes has been the relative insolubility of certain fluorides of the alkali metals and alkaline earths (for example, $CaF_2$ and $MgF_2$). Since the cations $Ca^{2+}$, $Mg^{2+}$, $Na^+$ and $K^+$ are abundant in the mineral matter typically accompanying coal, the consequence of the HF leaching of coal has been the formation of insoluble fluorides. In the product from such a leach, these insoluble compounds comprise ash precursors. Therefore, the efficiency of the ash reduction process is diminished by formation of insoluble fluoride compounds. Furthermore, the insoluble fluorides which exit the process with the beneficiated coal comprise a loss of fluoride from the system which must be compensated with alternate fluoride materials at additional expense. Moreover, when beneficiated coal containing fluorides is fired, it creates corrosion problems in the firing equipment. Additionally, the fluoride in the combustion gases constitutes a potential environmental threat. Finally, when the HF-beneficiated coal product containing alkali metal and alkaline earth fluorides is used as a fuel in heat engines, the cations of these insoluble fluorides, especially sodium and potassium cations, are quite damaging to the internal parts of heat engines, in particular gas turbines.

This situation presented an apparent dilemma to those practicing the prior art. On one hand, dissolving the aluminosilicate minerals commonly associated with coal was thought to require a high concentration of hydrofluoric acid (and, consequently, free fluoride ions). On the other hand, a concentration of free fluoride ions results in formation of highly insoluble alkaline earth fluorides and/or alkali metal fluorides.

One method which has been used in an attempt to solve the problem of the production of insoluble fluorides, has been to employ a different acid, often HCl alone, in a pre-leach, and/or in a subsequent leach. Such an HCl leach is effective in dissolving only some of these insoluble fluorides. For example, $Na_3AlF_6$ is substantially insoluble in HCl. Further, such an HCl leach is effective only when it is used alone, i.e. unmixed with HF. A difficulty with these answers to the insoluble fluoride problem is that the acid regeneration cycle becomes more complicated. In particular, it is necessary to provide two or more separate regeneration cycles for the different acids and acid mixtures. Accordingly, it would be desirable to provide an efficient method for leaching coal feed which contains insoluble fluoride-producing cations, such as Na, K, Ca, and/or Mg, using only HF or a mixture of HF and another acid such as HCl, but which both eliminates the need for a separate HCl pre-leach and regeneration cycle for HCl and avoids the formation of insoluble fluorides.

Because of the relative insolubility of many alkali metal and alkaline earth fluorides, prior methods of leaching with HF or an HF/HCl mixture have been less effective in removing basic ash minerals CaO, MgO, $Na_2O$, $K_2O$ and $Fe_2O_3$ (expressed as the ash oxides) than acidic ash minerals $SiO_2$, $Al_2O_3$ and $TiO_2$ (expressed as the ash oxides). Such difference in effectiveness of leaching causes an increase in the ratio of basic ash mineral to acidic ash mineral in the leach product of a conventional leach process. This is significant because the tendency of ash to slag or foul is increased as the ratio of basic ash oxides to acidic ash oxides increases. Thus, it would be desirable to provide a method for leaching a coal feed so as to produce a product with a low ratio of basic ash oxides to acidic ash oxides. To do so requires efficient leaching of basic minerals.

Accordingly, it is an object of this invention to provide a means for producing a reduced-ash coal product by leaching with a fluoride-containing acid while minimizing loss of fluorine values to insoluble alkaline earth fluorides and/or while eliminating the need for a separate HCl pre- or post-leach.

It is a further object of this invention to provide a leaching process which dissolves substantially all alkaline earth minerals, particularly calcium, occurring in the leach feed.

It is still a further object of this invention to produce a coal product using a leaching process which dissolves substantially all the alkali metal-containing minerals, particularly the sodium- and potassium-containing minerals, occurring in the leach feed.

It is also an object of this invention to provide a leaching process which produces a coal product with a lower ratio of basic ash oxides to acidic ash oxides than obtained by conventional HF leaching.

It is another object of this invention to provide a process for producing a reduced-ash coal product which includes an acid regeneration circuit, but wherein the amount of fluorine lost as alkali metal or alkaline earth fluoride is substantially reduced, and insoluble fluorides normally admixed in the coal product are substantially reduced or virtually eliminated.

It is yet another object of this invention to provide an improved process for producing a reduced-ash coal product wherein the improvement comprises adjusting concentrations of Al or Si species relative to the concentration of free-fluoride-ions so as to substantially prevent or reverse loss of fluorine values as insoluble fluorides, and so as to substantially eliminate insoluble fluorides in the final coal product.

It is still another object of this invention to provide a process for producing a reduced alkaline earth and/or reduced alkali metal coal product.

It is also an object to produce a finely-ground purged coal product usable not only as a substitute for petroleum fuels, e.g., as a boiler, diesel or turbine fuel, but also as a substitute for activated carbon, or as a feedstock for activated carbon, carbon black, electrode carbon, and various chemical processes.

SUMMARY OF THE INVENTION

These and other objects are achieved by the present invention which solves past problems by providing an integrated process for substantially reducing the amount of insoluble fluoride species, such as $CaF_2$, in the product of a coal cleaning process. The novel process of the present invention comprises leaching coal with a fluoride acid in the presence of an amount of fluoride-complexing species sufficient to form tightly-bound complex ions with substantially all free-fluoride-ions present, whereby leached coal and spent leach liquor are produced. Separating the leached coal from the spent leach liquor results in a leached product essentially free of alkali metals and alkaline earth metals either in the coal product or as insoluble fluorides admixed therewith.

In one embodiment, a two-stage leach process is provided which comprises an improvement over previous acid leaching methods. In the first stage, the coal is "pre-leached" according to the present invention, whereby formation of insoluble fluorides is prevented during the second leach of the circuit. This two-stage process may also include regeneration of the fluoride acid, e.g. hydrogen fluoride, and/or grinding of the coal products to a size suitable for use in coal-water mixtures and/or in fluid systems. The process may be performed in an unpressurized system and at moderate temperatures. The present invention provides fluoride acid leach processes which produce an ultra-clean coal product and which are effective even on low rank coals, i.e. coals with a relatively high content of minerals containing alkali metals (such as sodium or potassium) and/or alkaline earths (such as calcium or magnesium). The fluoride acid is preferably HF, and may be mixed with another acid, such as fluorosilicic acid or HCl, for practice of this pre-leach or free-fluoride-ion kill step. Practice of this invention eliminates the need for separate HCl leaching to remove alkali metal and alkaline earth minerals, yet can be operated without unacceptable loss of F as insoluble fluorides such as $CaF_2$.

The leach processes of the present invention are particularly useful when combined with a second stage strong acid leach and subsequent halogen removal and pyrite separation steps so as to produce an ultra-clean coal product. In particular, the processes of the present invention comprise a first stage leaching with a fluoride acid leach liquor in the presence of aluminum, silicon or other fluorine-complexing species which form tightly bonded complex ions with fluorine such as $SiF_6^{-2}$ or $AlF_6^{-3}$. The amount of fluorine-complexing species required is related to the amount of fluorine present as free-fluoride-ions. The concentration of such fluoride-complexing species with respect to the concentration of free-fluoride-ions in the leach slurry is adjusted such that at equilibrium there are or would be substantially no insoluble fluorides in the mixture. A sufficient amount of fluoride-complexing species will be present if there is some amount of the oxide of the fluoride-complexing species present in the aqueous slurry in solid form at equilibrium. Such solids are not problematic contaminants in the process to produce an ultra-clean coal product since they will be removed during the second stronger leach step. The feed is maintained in contact with the fluoride acid long enough to solubilize substantially all insoluble fluoride-forming cations, e.g. alkaline earth and alkali metals, in the feed. The solids are then separated from the spent leach.

To obtain an ultra-clean coal product, i.e. with an ash content of less than 5%, preferably less than 0.5%, this first stage is incorporated into an overall process comprising some or all of the following steps: (a) crushing or sizing feed to less than about 10 mm, preferably less than about ½ mm; (b) freeing pyrite (and other heavy minerals) and coal from attached silicates and aluminosilicates with substantially no breakdown of the coal and pyrite themselves, enabling a clean separation between coal (hydrocarbon) and pyrite (and other heavy minerals) by gravity or other means; (c) cleaning of the leached coal by washing and/or (d) heat treatment (e) pre-drying or physically beneficiating feed with high moisture of high mineral matter (ash) content and (f) subjecting the leached feed to a second, strong HF or mixed HF/HCl or $H_2SiF_6$/HF or HF/HCl/$H_2SiF_6$ acid leach. In the preferred processes the hydrofluoric acid, and/or the mixed acids are regenerated for use in the acid leaches.

In particular, one embodiment of the present invention provides a process for producing a coal product with 5 percent ash content or less comprising comminuting raw coal or other coal-derived feed material to a size less than about 10 mm, leaching the comminuted feed at atmospheric pressure and a temperature below boiling, preferably ambient, with a leach comprising HF in the presence of sufficient aluminum or silicon minerals to result in formation of SiO or $Al_2O_3$ in the residue, separating the residue from the spent acid, subjecting the residue to a second acid leach, washing the leached residue substantially free of spent acids and dissolved solids; separating pyrite from the coal by physical means; reducing halogens on the coal to an acceptable level; and regenerating the acids by pyrohydrolysis and/or sulfation of the spent leach, as described more fully hereinafter, to recover substantially all of the fluorine and chlorine values either as HF and HCl or volatile fluorides and chlorides which are recycled. Pyrohydrolysis refers generally to reactions at high temperature in the presence of water. Sulfation refers generally to contacting with sulfur dioxide ($SO_2$) also at high temperature.

In a process where the primary or sole objective is to clean coal by removing elements which ordinarily form insoluble fluorides in an HF leach, for example, alkaline earths such as Ca, as opposed to a process directed to total ash removal, the first stage or free-fluoride-ion kill leach described below may be utilized as the sole leach.

DETAILED DESCRIPTION

Figure 1:
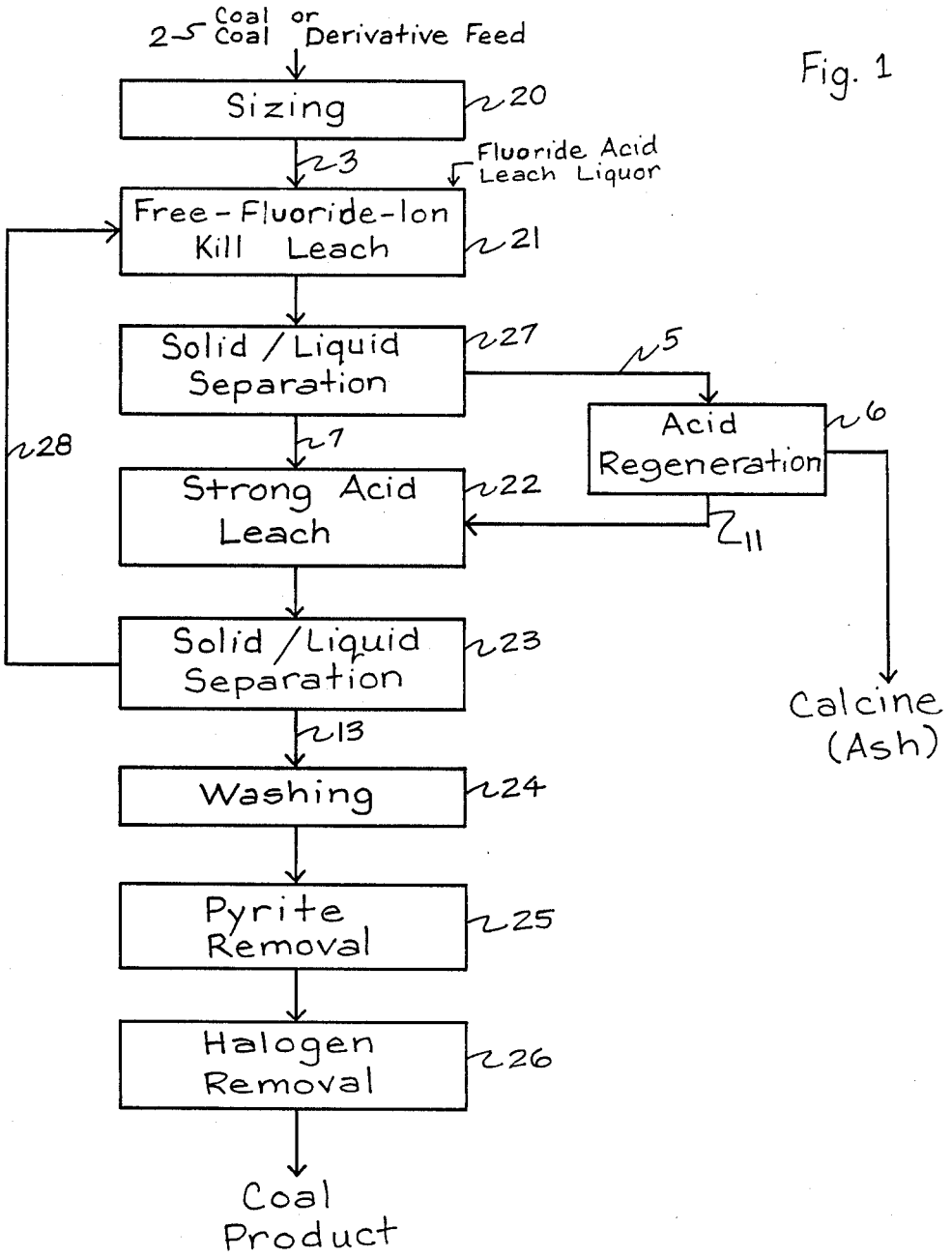
FIG. 1 is a schematic flow diagram of one embodiment of the present invention, showing an overall coal cleaning process, including an acid regeneration step and depicting the spent strong acid leach liquor as a source of the fluoride acid for the free-fluoride-ion kill leach.

The present invention relates to removal of certain contaminants from coal, i.e. alkali metals and alkaline earth metals, using fluoride acid leaching but without loss of fluorine and/or formation of appreciable amounts of insoluble fluorides.

The coal cleaning processes of the present invention are improvements over known acid leaching processes in that formation of insoluble fluorides, with the concomitant disadvantages, is avoided by use of a unique free-fluoride-ion kill leach. Basically, the free-fluoride-ion kill leach comprises leaching with a fluoride acid in the presence of an appropriate amount of a fluoride-complexing species as determined by the amount of free-fluoride-ions present.

As used herein, "fluoride acid" means a substance which, in aqueous solution, produces free-fluoride-ions and is acidic, i.e. produces hydrogen or $H^+$ ions (which may be hydrated as hydronium ions, $H_3O^+$), specifically including HF, and its aqueous solutions.

"Free-fluoride-ions" comprise both monoatomic anions of fluorine, (not associated with any cation) and multi-atomic anions containing fluorine and hydrogen. Examples of free-fluoride-ions are $F^-$ and $HF_2^-$. Free fluoride ions may be solvated or unsolvated.

The concentration of fluoride-complexing species is adjusted with respect to the concentraton of free-fluoride-ions present in the leach so that at equilibrium there are substantially no insoluble fluorides present. When the concentration of fluoride-complexing species is such that some amount of the oxide of the fluoride-complexing species is present in the leach slurry in solid form at equilibrium, then there will be substantially no insoluble fluorides present in the leach mixture. The substantial absence of any appreciable or significant amount of insoluble fluorides in the leach mixture and thus in the solid coal product separated therefrom is related to the belief that after adjustment according to the present invention, substantially no free-fluoride ion $F^-$ is available for formation of the undesirable insoluble fluorides. By practice of the present invention, substantially all insoluble fluorides are either prevented from forming due to the unavailability of free-fluoride-ions, or if formed prior to equilibrium, soon dissolve. In general, formation of insoluble fluorides is prevented or reversed by virtue of the greater affinity of the fluoride-complexing species for fluoride ions in comparison to the lesser affinity of alkali metals, alkaline earth metals and other insoluble fluoride-forming species for fluoride ions. In instances where there is a combination of leaches, i.e. multiple stage leaching, the free-fluoride-ion kill leach will preferably precede the strong acid leach. Thus, any oxides of the fluoride-complexing species will be substantially removed by the strong acid leach.

Feed which is useful for the practice of this invention is carbonaceous material admixed with minerals which contain certain alkali metals and/or alkaline earths, hereinafter referred to as "insoluble fluoride-forming species". The preferred feed is coal and coal derivatives which typically contain varying amounts of alkali metals and alkaline earths. The process of the present invention is particularly useful for treatment of coal and coal derivatives which contain alkali metal and/or alkaline earth elements such as sodium, potassium, magnesium and/or calcium, and particularly to treatment of subbituminous or other low rank coal and derivatives thereof which typically contain greater amounts of calcium than high rank coals. The feed will often contain some or all of the fluoride-complexing species necessary for practice of the invention as defined hereinbelow. Alternatively, appropriate feed may be carbonaceous material, e.g. coal or coal derivatives to which a fluoride-complexing species has been added.

Virtually any solid hydrocarbon including, for example, peat, coal, lignite, brown coal, gilsonite, tar sand, oil shale, etc., and including coal derivatives (hereinafter collectively referred to as "coal") may be treated by the processes of the present invention. Coal is a random mixture of dozens of minerals and moisture (impurities) with the hydrocarbons. The mixture varies from deposit to deposit, affected by differences in the original vegetation, microbiology, adventitious mineralization, heat, pressure, hydrology, and geologic age. Table A lists the common minerals found in coal.

TABLE A

Common Minerals Found in Coal

Muscovite ($KAl_2(AlSiO_3O_{10})(OH)_2$)
Hydromuscovite
Bravaisite
Kaolinite ($Al_2Si_2O_5(OH)_4$)
Levisite
Metahalloysite
Siderite ($FeCO_3$)
Hematite ($Fe_3O_4$)
Sylvite (KCl)
Halite (NaCl)
Quartz ($SiO_2$)
Feldspar $(K,Na)_2O\ Al_2O_3\ 6SiO_2$
Zircon ($ZrSiO_4$)
Diaspore ($Al_2O_3\ H_2O$)
Lepidocrocite ($Fe_2O_3\ H_2O$)
Kyanite ($Al_2O_3\ SiO_2$)
Staurolite ($2FeO\ 5Al_2O_3\ 4SiO_2\ H_2O$)
Topaz $(AlF)_2SiO_4$ Tourmaline $H_9Al_3(BOH)_2Si_4O_{19}$
Pyrophyllite ($Al_2Si_4O_{10}(OH)_2$)
Illite ($K(MgAl,Si)(Al,Si_3)O_{10}(OH)_8$
Montomorillonite $(MgAl)_8(Si_4O_{10})_3(OH)_{10}\ 12H_2O$
Prochlorite ($2FeO\ 2MgO\ Al_2O_3\ 2SiO_2\ 2H_2O$)
Chlorite $(Mg,Fe,Al)_6(Si,Al)_4O_{10}(OH)_8$
Gypsum ($CaSO_4\ 2H_2O$)
Barite ($BaSO_4$)
Penninite ($5MgO\ Al_2O_3\ 3SiO_2\ 2H_2O$)
Ankerite $CaCO_3\ (Mg,Fe,Mn)CO_3$
Garnet ($3CaO\ Al_2O_3\ 3SiO_2$)
Hornblende ($CaO\ 3FeO\ 4SiO_2$)
Apatite ($9CaO\ 3P_2O_5\ CaF_2$)
Epidote ($4CaO\ 3Al_2O_3\ 6SiO_2\ H_2O$)
Biotite ($K_2O\ MgO\ Al_2O_3\ 3SiO_2\ H_2O$)
Augite ($CaO\ MgO\ 2SiO_2$)
Calcite ($CaCO_3$)
Magnetite ($Fe_2O_3$)
Pyrite ($FeS_2$)
Marcasite ($FeS_2$)
Sphalerite ($ZnS$)

Specific additonal steps are provided to obtain a coal product substantially free of ash-precursors including insoluble alkali metal and alkaline earth fluorides, i.e. a product containing less than 5 percent by weight, more preferably from about 3.0 to less than 1.0, and most preferably less than 0.2 percent by weight ash-precursors.

The minerals (precursors of ash) in coal and coal derivatives impede the combustion of the hydrocarbons and create problems ranging from ash removal to the release of airborne pollutants, e.g. oxides of the sulfur which are present in coal dominantly in two forms, pyritic and organic. In the practice of the present invention the particular combination of process steps and/or the process conditions for such steps for overall ash removal are in large part determined by the level and nature of impurities in the particular feed.

Treatments prior to contact with an acid leach:

Depending on the particular feed, it may be advantageous to physically and/or chemically pre-treat the feed prior to leaching.

A. Drying—Feed coal such as sub-bituminous lignites or other low rank coals may be dried prior to further treatment. Where the feed is Western, U.S. sub-bituminous coals or coals of lower rank, as defined by thermal value, which typically contain about 25 weight percent moisture, it may be advantageous to dry the feed to substantially reduce this inherent moisture content, preferably to below about 5 percent by weight.

B. Crushing/Sizing—With most feeds, the contaminant removal process is enhanced by crushing or sizing the feed to a particular size of less than 10 mm, preferably less than about 5 mm, and more preferably less than about ½ mm.

C. For coals with high mineral matter (ash precursor) content it is usually an advantage to effect a physical separation prior to other treatment provided the removal of ash is not accompanied with a concomitant high loss of heating value.

Free-Fluoride-Ion Kill Leach

By practice of the present invention wherein the feed is slurried or otherwise contacted with a fluoride acid and a sufficient quantity of fluoride-complexing species, the slurry created during or discharging from this leach contains sufficient quantities of tightly bound complex fluoride ions in solution such that the amount of free-fluoride-ion is below that needed to form or permit existence of appreciable quantities of the undesirable insoluble fluorides. The presence, at equilibrium, of solid oxides of fluoride-complexing species can be taken as an indication that the amount of fluoride-complexing species is at least sufficient to complex all free-fluoride-ions present. In defining the amount of fluoride-complexing species sufficient for practice of the invention, the leach slurry is presumed to be at equilibrium conditions, i.e. at conditions under which any insoluble fluoride which forms will redissolve.

By "insoluble fluorides" is meant alkaline earth and/or alkali metal fluorides, and specifically fluorides containing cations from groups IIA and IA respectively, either as simple fluorides, such as $CaF_2$ or $MgF_2$, or complex fluorides where two or more cations and fluorine comprise the compound. Insoluble alkali metal fluorides will typically be complex fluorides, rather than simple fluorides. The solubility of these insoluble fluorides under conditions of a conventional leach is typically less than about 0.1 grams/100 ml of leach solution.

"Complex fluoride ions," as used herein refers to coordination anions existing in aqueous media in which fluoride ions cluster about a central cation forming an aggregate ion. $AlF_6^{3-}$, $AsF_6^-$, $SbF_6^-$, $BF_4^-$, $GeF_6^{2-}$, $FeF_4^-$, $FeF_6^{3-}$, $PF_6^-$, $TiF_6^{2-}$, $SiF_6^{2-}$ and other complex zirconium ions are examples of complex fluoride ions. "Tightly bound complex ions" as used herein refers to complex fluoride ions in which the central cation has a greater affinity for capturing free fluoride ions (thereby forming the complex) than do the cations of the insoluble alkaline earth and/or alkali metal fluorides, for example calcium and magnesium. $AlF_6^{3-}$ and $SiF_6^{2-}$ are examples of tightly bound complex fluoride ions. "Fluoride-complexing species", as used herein, refers to species, such as $Si^{+4}$ and $Al^{+3}$, which form tightly bound complex ions with fluorine, e.g. $SiF_6^{-2}$ and $AlF_6^{-3}$.

Practice of the present invention reduces the level of free fluoride ions in the free-fluoride-ion kill leach at equilibrium to a level insufficient to permit the presence of any (or any significant quantity of) insoluble fluorides at equilibrium.

According to the processes of the present invention depicted in FIGS. 1-4, the coal feed 2, optionally pretreated by one or more of the pre-leach treatments described hereinbefore, is contacted with a fluoride acid, conveniently at temperatures below boiling and normally at ambient pressure. Typically the source of this fluoride acid is the actual or modified spent strong acid from the strong acid leach of the overall ash removal process. The fluoride acid may comprise HF, and may be mixed with another acid such as $H_2SiF_6$ or HCl.

Of the 39 minerals listed in Table A, HF is extremely reactive in attacking the silicates and alumino-silicates including clays and shales. By the method of the present invention, the formation of insoluble alkali metal fluoride and/or alkaline earth fluoride species, particularly $CaF_2$, is substantially prevented or reversed by maintaining in the acid-feed mixture, a sufficient concentration of fluoride-complexing species.

The process of the present invention comprises adjusting the ratio of the concentration of fluoride-complexing species, to the concentration of free-fluoride ions such that there are substantially no insoluble fluoride species in the mixture. "Adjustment" or "adjusting" can be by a number of alternative methods described in more detail hereinbelow, such as adding fluoride-complexing species to the feed or the slurry and/or adjusting the free-fluoride level of the leach prior to contact with the feed. In particular, the method of the present invention comprises subjecting coal to a free-fluoride-ion kill leach 21 in which the concentration of fluoride-complexing species with respect to the concentration of free-fluoride-ions is sufficiently high, such that if the mixture is allowed to reach equilibrium, substantially all free-fluoride-ions will form tightly bound complex ions with the fluoride-complexing species. In other words, the concentration of fluoride-complexing species with respect to the concentration of free-fluoride-ions is adjusted such that substantially all of the free-fluoride-ions form tightly bound complex ions with the fluoride-complexing species, substantially all alkali metal and alkaline earth species present are soluble in the leach, and there is substantially no formation of insoluble fluorides at equilibrium. It is recognized that when the feed is initially contacted with fluoride acid, some insoluble fluorides may temporarily form. When the leach is conducted as described herein, however, these temporarily formed insoluble fluorides will dissolve in the leach liquor as the leach approaches equilibrium.

Although as the leach proceeds it will approach a state of equilibrium, it is not necessary for the leach to proceed to the point of theoretically complete equilibrium. However, it is necessary for the leach to proceed to the point where there are substantially no insoluble fluoride species in the mixture and/or where the concentration of free-fluoride-ions in the solution is sufficiently low as to not be available to form appreciable amounts of insoluble fluorides. Alternatively, it is sufficient for the leach to proceed to a point where solid oxides of the fluoride-complexing species precipitate.

In most applications of this invention, something less than 100% removal of alkali metal and alkaline earth species will result. This is explained at least in part by the fact that not all such species are available to the leach liquor in the sense that even in finely-ground feed, some portion of the alkali metal and alkaline earth species will be encased in substantially impermeable carbonaceous material. In addition, as will be known and understood by those skilled in the art, even at equilibrium conditions under which substantially no insoluble fluorides such as $CaF_2$ should exist, molecules will nevertheless be constantly precipitating and dissolving.

Tightly bound complex fluoride ions typically have little tendency to hydrolyze. That is, the equations $$AlF_6^{3-}{}_{(aq)} + 1.5H_2O_{(l)} \rightleftharpoons 0.5Al_2O_{3(s)} + 3H^+_{(aq)} + 6F^-_{(aq)} \quad \text{(i)}$$

$$SiF_6^{2-}{}_{(aq)} + 2H_2O_{(l)} \rightleftharpoons SiO_{2(s)} + 4H^+_{(aq)} + 6F^-_{(aq)} \quad \text{(ii)}$$

will be strongly shifted to the left provided there is solid $Al_2O_3$ and/or solid $SiO_2$ present in the mixture. Thus, the present invention includes leaching at conditions and/or in the presence of an amount of fluoride-complexing species sufficient to produce some amount of solid $SiO_2$ or $Al_2O_3$ at equilibrium.

For the free-fluoride-ion kill leach 21 to be effective, there must be sufficient cations available which form tightly bound complex fluoride ions in order to reduce the free fluoride ions to an exceedingly small value. The amount of cations required is the mole ratio found in the complex fluoride ion; for example, one mole of $Al^{3+}$ will complex six moles of $F^-$ as $AlF_6^{-3}$, and one mole of $Si^{+4}$ will complex six moles of $F^-$ as $SiF_6^{-2}$. When the fluoride-complexing species is aluminum, the operative amount is such that the ratio of the weight of aluminum to the weight of fluorine is about 0.237. When the fluoride-complexing species is silicon, the operative amount is such that the ratio of the weight of silicon to the weight of fluorine is about 0.246. Typically the leach will have more than one type of cation available which forms tightly bound complex fluoride ions. For example both $AlF_6^{3-}$ and $SiF_6^{2-}$ may be formed, and each makes a contribution toward removing free fluoride ions from solution. A higher ratio of fluoride-complexing species to fluoride may be present, provided it is not so much as to interfere with the objectives of the process. Choice of the exact ratio may be affected by such considerations as reagent costs, or reaction kinetics. In addition, use of excess fluoride-complexing species may be dictated in two-stage leaching processing by the primary goal of avoiding formation of insoluble fluorides coupled with the easy removal of SiO and/or $Al_2O_3$ from the residue during the second stage, strong acid leach.

Adjusting or maintaining the ratio of the concentration of fluoride-complexing species to the concentration of free-fluoride-ions may be effected by adjusting the concentration of free-fluoride-ions in or going to the leach, by adjusting the concentration of fluoride-complexing species, or by adjusting both concentrations. Adjustment may involve addition of fluoride-complexing species directly to the leach or indirectly to any stream, or removal of free-fluoride-ions, for example as HF.

Most conveniently and economically, the adjustment is accomplished by adjusting the concentration of free-fluoride-ions in or going to the leach and specifically by adjusting the concentration of the fluoride acid. When, as is typically the case, the feed naturally contains an amount of fluoride-complexing species, adjustment of the concentration of free-fluoride-ions may, by itself, suffice to produce the required ratio. For example, if a liter of the slurry contains 7 grams of Si, a concentration of about 28.5 grams of F per liter of the slurry will be operative.

Figure 2:
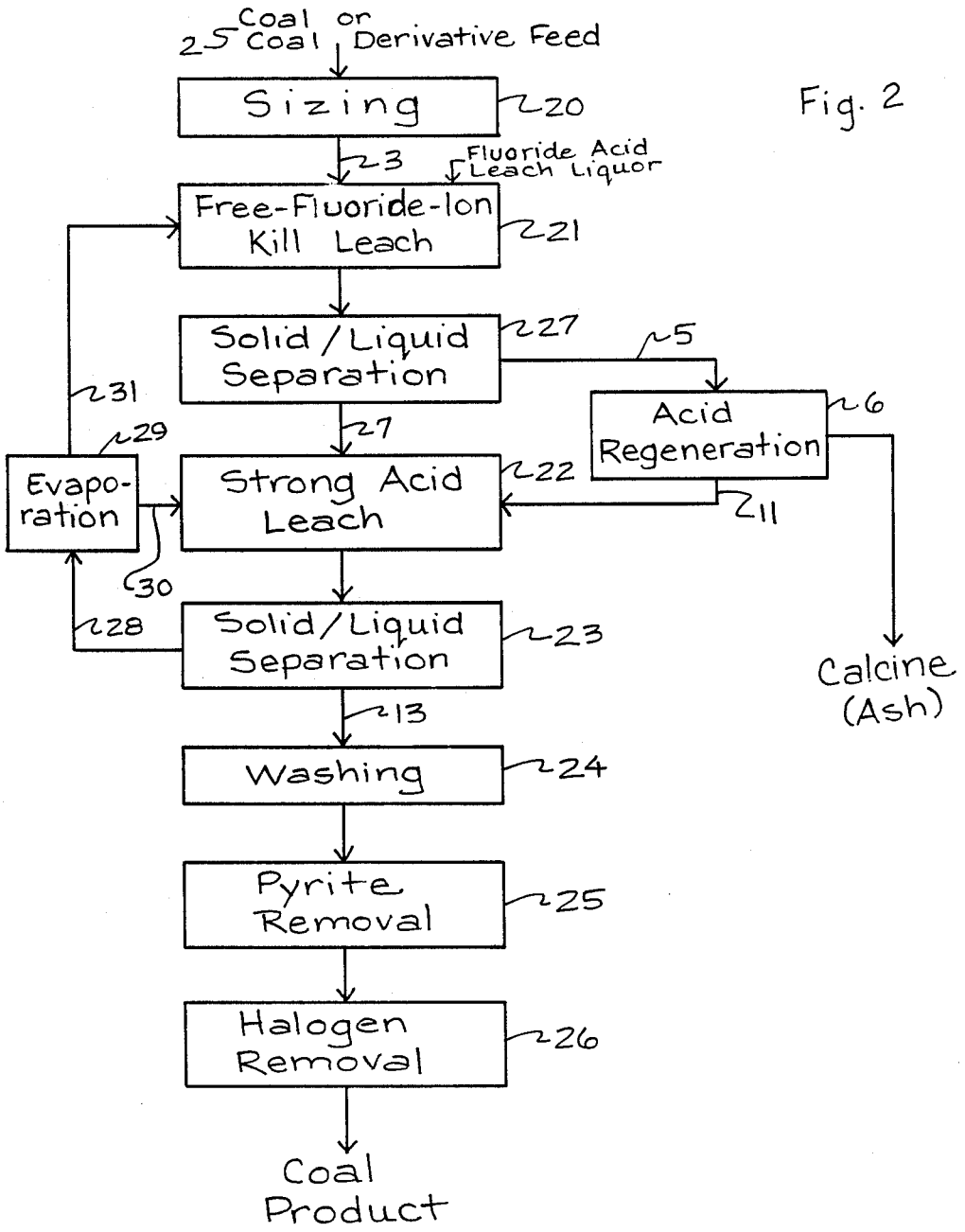
FIG. 2 is a schematic flow diagram showing another embodiment wherein the evaporation step is a means of further lowering the free-fluoride-ion concentration of the partially free-fluoride-ion depleted liquor emanating from the strong acid leach.

As depicted in FIGS. 1–4, the leach liquor for the free-fluoride-ion kill leach 21 may derive from the effluent or partially spent liquor from a second leach of the solids called the strong acid leach 22. If the partially spent acid from the strong acid leach 28, contains more free fluoride ion that can be tightly bound by available fluoride-complexing species present in the minerals associated with the feed, then free fluoride ions may be removed (as HF), as depicted in FIG. 2, by evaporation 29 to a level where the remaining $F^-$ can be tightly bound in complex fluoride ions by available fluoride-complexing species in the feed. To help with dissolution of minerals, it may be advantageous for the free-fluoride-ion kill leach 21 to have some amount of free-fluoride-ions present during the initial period of the leach, provided that at equilibrium, substantially all free-fluoride-ions have formed tightly-bound complex ions with the fluoride-complexing species. The minimum concentration of fluoride acid necessary for practice of this invention will vary with the characteristics of the feed.

The presence of other acids, such as HCl may be convenient or desirable in the free-fluoride-ion kill leach liquor, so long as the required ratio of fluoride-complexing species to free-fluoride ions is maintained.

Figure 3:
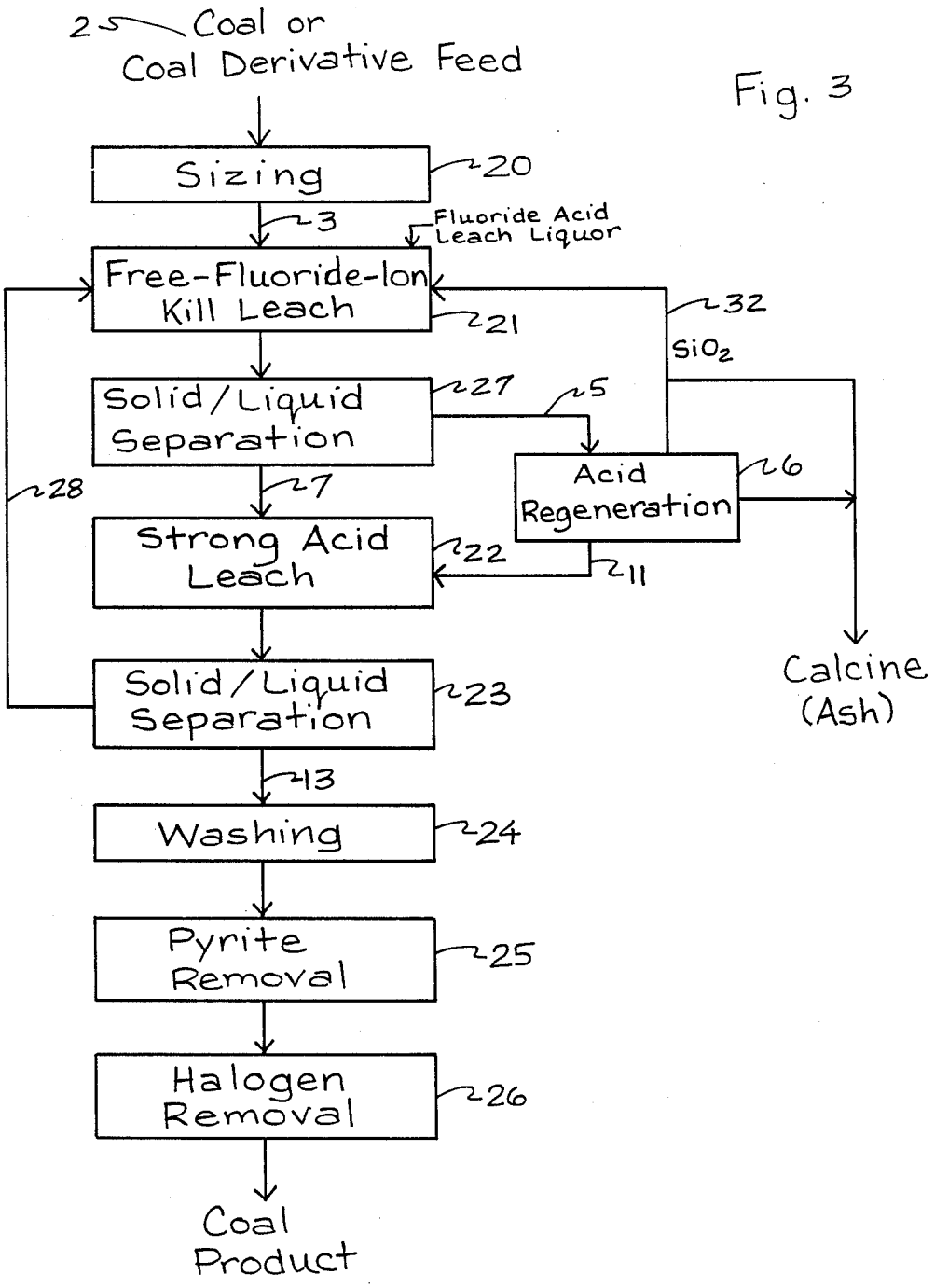
FIG. 3 is a schematic flow diagram showing a third embodiment wherein the acid regeneration step is an $SiO_2$ source providing Si to complex free-fluoride-ions in the free-fluoride-ion kill leach.

The ratio may also be maintained in the required range by adjusting the concentration of fluoride-complexing species, particularly the concentration of silicon or aluminum species. As noted, the feed may contain sufficient fluoride-complexing species to maintain the ratio within the desired range. It may be necessary or desirable to maintain the ratio in a desired range by adding an amount of fluoride-complexing species to the acid-feed mixture. Fluoride-complexing species may also be added to one of the free-fluoride-ion kill leach feed streams, such as the coal feed stream or the incoming leach liquor stream. Fluoride-complexing species are conveniently added to the leach mixture and/or to any incoming stream by adding a species which, in solution, will produce fluoride-complexing species, such as oxides like $Al_2O_3$ and/or $SiO_2$. One source of such oxides, as depicted in FIG. 3, may be the acid regeneration step discussed below.

Among the objects of this free-fluoride-ion kill leach 21 are: (1) maximizing dissolution of alkaline earth and alkali metal species in the leach; (2) minimizing precipitation of insoluble fluorides such as $MgF_2$ and/or $CaF_2$; and (3) producing a low ratio of basic ash oxides to acidic ash oxides. Thus, the feed should be maintained in contact with the fluoride acid for a time sufficient to dissolve substantially all the alkaline earth and alkali metal in the feed. It has been found that the kinetics of the reaction are such that formation of tightly-bound complex fluoride ions and the consequent prevention or reversal of formation of insoluble fluorides takes place within the time period typically required for a conventional acid leach. In particular, a contact time of between about 0.5 hours and about 5 hours is operative for this purpose.

The temperature of the leach will affect both the solubility products of the species in the mixture and the speed of solution and reaction. Maintaining contact at a temperature substantially equal to or greater than ambient temperature is operative. Preferably the temperature is less than the boiling point of the fluoride acid.

The slurry 7 from this free-fluoride-ion kill leach will contain coal solids including some undissolved ash-forming minerals and also, in practice, some oxides of the fluoride-complexing species, but substantially no insoluble alkaline earth and/or alkali metal fluorides. The liquor component of this slurry will contain cations which could form insoluble alkaline earth and/or complex alkali metal fluorides if contacted with free fluoride ions. The fluoride acid-leached solids 7 are separated from the spent free-fluoride-ion kill leach liquor by such methods as settling, decantation, or filtration, and the separated solids may be washed free of adhering leach liquor. The separated spent free-fluoride-ion kill leach liquor 5 may be recycled 33 (FIG. 4) as a component of the acid leach 21, or may be advanced to an acid regeneration step 6.

Acid Regeneration

The spent free-fluoride-ion kill leach liquor 5 (containing calcium and other species dissolved from the mineral matter) is advantageously treated in a fashion to yield an environmentally satisfactory material for disposal. Additionally, it may be economically desirable to regenerate HF, $H_2SiF_6$, and any HCl present for reuse 11 in the leaching circuit. Pyrohydrolysis of the spent free-fluoride-ion kill leach liquor, possibly combined with sulfation constitutes a means of achieving both objectives. The gaseous HF and HCl are removed with the hot off-gases while the oxides/sulfates formed are separated therefrom.

Examples of some of applicable chemical reactions of the acid regeneration are as follows:

$$2AlF_{3(s)}+3H_2O_{(g)}=Al_2O_{3(s)}+6HF_{(g)} \quad \text{(iii)}$$

$$SiF_{4(g)}+2H_2O_{(g)}=SiO_{2(s)}+4HF_{(g)} \quad \text{(iv)}$$

$$TiF_{4(g)}+2H_2O_{(g)}=TiO_{2(s)}+4HF_{(g)} \quad \text{(v)}$$

$$4PF_{5(g)}+10H_2O_{(g)}=P_4O_{10(g)}+20HF_{(g)} \quad \text{(vi)}$$

$$2FeF_{3(g)}+3H_2O_{(g)}=Fe_2O_{3(s)}+6HF_{(g)} \quad \text{(vii)}$$

$$CaF_2+H_2O_{(g)}+SO_{2(g)}+0.5O_{2(g)}=CaSO_{4(s)}+2HF_{(g)} \quad \text{(viii)}$$

$$2NaCl+H_2O_{(g)}+SO_{2(g)}+0.5O_{2(g)}=Na_2SO_{4(s,l)}+2HCl_{(g)} \quad \text{(ix)}$$

$$2KCl_{(g)}+H_2O_{(g)}+SO_{2(g)}+0.5O_{2(g)}=K_2SO_{4(s)}+2HCl_{(g)} \quad \text{(x)}$$

According to the process of the present invention, a portion of the silica present in the leach may optionally be removed prior to pyrohydrolysis/sulfation. In the aqueous solution containing silica, the silica is generally bound as fluorosilicic acid $H_2SiF_6$. One process for removing silica from the leach liquor is by heating to the point where fluorosilicic acid disassociates as follows:

$$H_2SiF_6(\text{aqueous})=2HF(\text{gas})+SiF_4(\text{gas})+H_2O(\text{gas}) \quad \text{(xi)}$$

Another process for removing silica generally comprises precipitating the silica and removing the precipitant from the aqueous feed solution by filtration. In this silica removal method, an aluminum oxide-rich material containing approximately 30% or more by weight $Al_2O_3$ is contacted with the aqueous solution. Upon introduction of the $Al_2O_3$ for precipitation of the silica, the $H_2SiF_6$ and $Al_2O_3$ react according to the following formula:

$$Al_2O_3+H_2SiF_6=2AlF_3+SiO_2(\text{ppt.})+H_2O \quad \text{(xii)}$$

The $SiO_2$ precipitant is removed by any convenient means, for example by filtration.

Should Si be present in the pyrohydrolysis step, the water vapor should be present in an amount equal to from one (1) to about ten (10) times or more the stoichiometric amount of $H_20$ necessary to regenerate HF from all the fluorides present in the spent leach if the regeneration temperature is to be maintained below about 1000° C. The above-discussed free-fluoride-ion kill leach step may comprise adding $SiO_2$ (or $Al_2O_3$) produced in the acid regeneration step 32 to the acid feed mixture.

Strong Acid Leach

A purpose of the above-described free-fluoride-ion kill leach step is to dissolve the alkaline earth and alkali metal compounds, particularly the calcium compounds, from the feed without forming insoluble fluorides such as $CaF_2$. Such leach also serves to dissolve a number of other constituents of the feed. As indicated above, when the feed is sufficiently low in ash precursors or when production of a reduced alkaline earth coal product is the primary objective of the process, the free-fluoride-ion kill leach may suffice to produce the desired objective. In most cases, particularly in the overall processing to obtain an ultra-clean hydrocarbon from coals, the fluoride acid-leached solids from the free-fluoride-ion kill leach will contain sufficient ash precursors that treatment is desirable to further reduce the ash content. As used herein, "strong acid leach" means any HF-containing leach which is employed to further leach the separated fluoride acid-leached solids. This leach 22 will have a lower pH than the fluoride acid pre-leach. The strong acid leach liquor will typically comprise a halogen acid such as HF and/or HCl but may include other acids such as $H_2SiF_6$. In the preferred embodiment, the strong acid leach liquor comprises the same acids used in the free-fluoride-ion kill leach.

In the preferred embodiment, the strong acid leach liquor contains a sufficient concentration of HF to dissolve the oxides, for example $Al_2O_3$ and/or $SiO_2$ (and any minerals recalcitrant to the free-fluoride-ion kill leach). The strong acid leach can be conducted, e.g. with high concentration of free-fluoride-ions, without concern for precipitation of insoluble alkaline earth and/or alkali metal fluorides, since cations capable of precipitating insoluble fluorides were previously removed in the liquor which was separated from the coal and oxide solids of the discharge slurry from the free-fluoride-ion kill leach. Additionally it may be desirable or convenient for the strong acid leach liquor to comprise acids, such as HCl. HCl is useful in a strong acid leach when, for example, it is desired to remove substantially all aluminum compounds from the feed. The separated fluoride acid-leached solids 7 are contacted with the strong acid leach liquor, and maintained in contact for a time sufficient to dissolve substantially all ash-precursors in the fluoride acid-leached solids. In one preferred embodiment of this invention, this strong acid leach comprises less than 70 weight percent HF and less than 38 percent HCl. The source of all or a portion of this HF may be the acid regeneration step described above.

The fluoride acid used in the free-fluoride-ion kill leach may comprise the partially free-fluoride-ion depleted or spent strong acid leach liquor 28, that is, the spent strong acid leach liquor 28 may be a component of the fluoride acid leach as depicted in FIGS. 1–4. Alternatively, the spent strong acid leach liquor 28 may be recycled 34 as a component of the strong acid leach liquor (FIGS. 2 and 4), or may be regenerated 12. Such spent strong acid leach liquor regeneration process may comprise some or all steps described above in connection with the fluoride acid leach regeneration process. Further, treatment of the spent strong acid leach liquor may comprise a concentration step to adjust the concentration of the spent strong acid leach liquor. The regenerated HF 11 or the concentrated spent strong acid leach liquor 30 from the evaporator, FIG. 2, may be used as strong acid leach liquor. The weak HF solution 31 issuing from the concentration step may form a portion of the fluoride acid. The concentrating step may comprise evaporation 29.

Pyrite Removal

Gravity (including tabling) or other physical or physio-chemical separations are facilitated by the removal of virtually all non-pyritic (aluminosilicate and other non-sulfide) mineral matter according to the leach steps of the present invention. The leach steps of the present invention make more distinct the differences in certain physical properties between coal aggregates and pyrite aggregates. When coal and pyrite are physically aggregated with substances such as aluminosilicates possessing intermediate values of these physical properties, the coal aggregates and pyrite aggregates tend to have largely indistinguishable physical properties. The large differences in the specific gravities, magnetic susceptibilities, surface properties, etc. of coal and pyrite solids after leaching for mineral matter removal are examples of material differences in physical properties which may be used to effect a separation between pyrite and coal. For purposes of the present invention, pyrite is physically separated 25 from the coal product either by gravity separation techniques known in the art by magnetic separation or other methods. Efficient physical separation is possible because the upstream process according to the present invention chemically liberates the pyrite and hydrocarbon by dissolution of the aluminosilicate and other non-sulfides cementing the locked minerals (minerals/hydrocarbon) together.

Washing

Washing the coal product 24 to remove dissolved cations and anions can be advantageously effected by any number of systems and washes. Typically, a multiple (four) stage decantation system with minimum water addition may be used. The washing circuit may optionally be operated in conjunction with filters and/or centrifuges. In such a system, retention time is about thirty hours during which there is adequate diffusion of halogens from the coal product. In addition to long-term washing with water, as in a multi-stage CCD circuit, halogen removal can also be effected by addition of various compounds such as acetic acid, nitric acid, alcohol (90% ethanol, 5% methanol and 5% isopropyl) and ammonium hydroxide, and by heating to below boiling the water or solutions described above or by thermal treatment described below.

The coal product of the present invention has fast thickening and filtration rates as compared to conventional coal slurries, due to the absence of clays which have been removed upstream.

Heat Treatment

As an alternative or addition to washing with water or solutions previously described, the coal product may be thermally treated 26, for example, by baking to a temperature below about that of incipient loss of hydrocarbon volatiles, from about 225° C. to about 400° C., preferably from about 300° to about 350° C., and most preferably about 325° C., for a sufficient time, e.g. to achieve halogen removal to less than about ½ percent by weight. The upper temperature is in large part determined by a desire to avoid loss of hydrocarbon value through driving off low volatilizing components.

As will be known to those skilled in the art, the order of the process steps may be varied from that depicted in FIGS. 1–4, and, in particular, the washing 24, pyrite removal 25 and halogen removal 26 may be performed in another order, or one or more of these steps deleted, depending on, among other factors, the characteristics of the process feed.

Referring again to FIG. 1, a process according to the present invention is depicted wherein the free-fluoride-ion-kill leach 21 is combined with a strong acid leach 22. The feed coal or coal derivatives 2 is typically high calcium content, low rank coal. In practice, the concentration and the refractory nature of alkali metals and alkaline earths in the feed 2 is variable, so that monitoring of the feed 2 may be required to properly maintain the required ratio of fluoride-complexing species to free-fluoride ions in the subsequent free-fluoride-ion kill leach 21. The feed 2, which may be subjected to physical beneficiation, is subjected to crushing or sizing 20 to about 10 mm or less. In some instances sizing to less than about 5 mm and preferably to approximately ½ mm may beneficially affect downstream process steps. Crushing or sizing may be by any means whereby the desired size feed particles are obtained. The sized feed 3 is then subjected, in the presence of a fluoride-complexing species, to a free-fluoride-ion kill leach 21, primarily for removal of substantially all alkali metal and alkaline earth minerals.

The free-fluoride-ion kill leach liquor comprises a fluoride acid and may further comprise an acid such as HCl. The ratio of the concentration of the fluoride-complexing species to free-fluoride-ions is adjusted so as to preclude precipitation of appreciable amounts of alkali metal fluorides and alkaline earth fluorides in the leach 21 at equilibrium. A practical indicator that at least a sufficient amount of fluoride-complexing species is present is the presence in the leach slurry of some amount of the oxide of a free-fluoride-complexing species in solid form.

Adjusting the amount of fluoride complexing species may be accomplished by adding an amount of fluoride-complexing agent to the feed 2, to the incoming leach liquor, or directly to the leach 21. Most conveniently and economically, however, the adjustment is accomplished by employing the acid 31 (FIG. 2) emanating from the evaporation step 29 as the source of the fluoride acid for the free-fluoride-ion kill leach 21. The concentration of fluoride acid in the free-fluoride-ion kill leach however, must not be so low as to fail to accomplish the objective of dissolving substantially all available alkali metals and alkaline earths in the feed 2.

The leach 21 is efficient for removing non-sulfide mineral matter over a wide range of temperatures (ambient to below boiling). The free-fluoride-ion kill leach 21 extends preferably for a period of between about 0.5 and about 5 hours. A solid/liquid separation 27 is made, and the spent free-fluoride-ion kill leach liquor 5 is advanced to the acid regeneration circuit 6. All or a portion of the regenerated fluoride acid and any regenerated HCl 11 may be directed to the strong acid leach 22. The calcine ash is removed from the acid regeneration circuit and disposed of.

The fluoride acid-leached solids 7 are subjected to a strong acid leach 22. The strong acid leach step 22 extends preferably for a period of about 0.5 to about 5 hours. A solid/liquid separation 23 is made and the spent strong acid leach liquor 28 is advanced to the free-fluoride-ion kill leach 21.

The strong acid leached solids 13 may be directed to further processing steps: washing 24, pyrite removal 25, or halogen removal 26. It should be noted that during the solid/liquid separations it is particularly advantageous to separate and remove leached fines with the spent acid as would occur by using cyclones. Not only will subsequent solid/liquid separations be facilitated but when regeneration of the acids is by pyrohydrolysis, the fines may be used as a fuel source to at least partially fire the regeneration step.

Referring to FIG. 2, the spent strong acid leach liquor 28 may be advanced to an evaporation step 29 which is a source for a strong acid 30 for introduction into the strong acid leach 22 and/or an acid reduced in $F^-$ 31 for introduction into the free-fluoride-ion kill leach 21.

Referring to FIG. 3, when the acid regeneration step 6 is of a type which produces $SiO_2$, this acid regeneration-produced $SiO_2$ 32 may be introduced into the free-fluoride-ion kill leach 21 to adjust the ratio of the concentration of silicon to fluorine.

Figure 4:
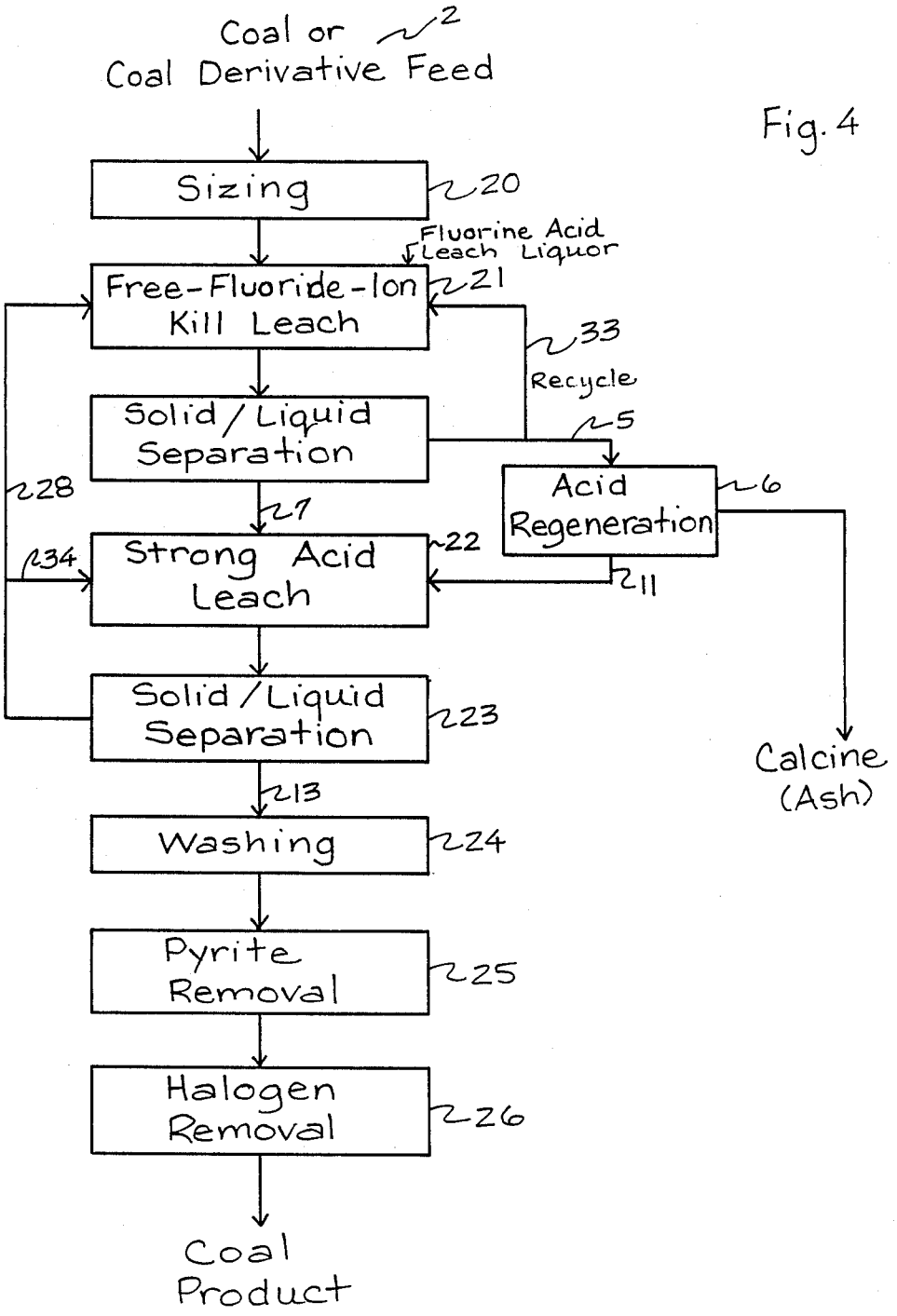
FIG. 4 is a schematic flow diagram showing a fourth embodiment wherein recycle steps for the free-fluoride-ion kill leach and the strong acid leach are present.

Referring to FIG. 4, a portion of the spent free-fluoride-ion kill leach liquor 33 may be recycled as a component of the free-fluoride-ion kill leach 21. Similarly, a portion of the spent strong leach liquor 34 may be recycled as a component of the strong acid leach 22.

Practice of the method of the present invention comprising (a) contacting coal, preferably comminuted to a size of about 10 mm or less, with a fluoride acid in the presence of a fluoride-complexing species below the leach liquor boiling point, preferably at ambient temperature, to produce a spent free-fluoride-ion kill leach liquor and fluoride acid-leached solids and (b) separating said spent free-fluoride-ion kill leach liquor from said fluoride acid-leached solids results in unexpected efficient contaminant (ash precursor) liberation and removal. In particular, substantially all alkali metal and alkaline earth in the feed is dissolved in the time period of a conventional leach, but with substantially no precipitation of insoluble fluorides.

The following examples are provided by way of illustration and not by way of limitation.

EXAMPLE 1

Example 1 present results from two tests employing previously known methods. Tests 1 and 2 represent a 4-hour HF leaching of a −20 mesh subbituminous coal (which, typically, is high in alkaline earth and alkali metal compounds) with, respectively, 15% and 40% HF at 10% solids and at 30° C. These conditions supply a considerable excess of free-fluoride-ions. As a consequence, the removal of alkaline earth and alkali metal compounds by the leach is poor (due to the insolubility of the fluorides). As can be seen in Table 1, high concentrations of HF are ineffective in producing good extractions of the alkaline earth and alkali metal impurites.

TABLE 1

| Impurities, expressed as oxides | Impurity Extractions | |
|---|---|---|
| | Test 1, 15% HF | Test 2, 40% HF |
| Alkaline earths | | |
| CaO | 19.7 | 20.0 |
| MgO | 13.6 | 25.1 |
| Alkali metals | | |
| $Na_2O$ | 72.9 | 87.7 |
| $K_2O$ | 75.3 | 84.9 |

EXAMPLE 2

Example 2 presents results from a test employing previously known methods. In Test 3, a −28 mesh bituminous coal was leached at ambient temperature and 30% solids with a mixed acid, 20% HF and 20% HCl. Even though the alkaline earth and alkali metal compounds are relatively soluble in HCl alone, again, the excess of free-fluoride-ions from the HF renders the alkaline earth and alkali metal compounds poorly soluble, as seen in Table 2.

TABLE 2

| Impurities, expressed as oxides | Impurity Extractions Test 3, 20% HF |
|---|---|
| Alkaline earths | |
| CaO | 18.2 |
| MgO | 38.7 |
| Alkali metals | |
| $Na_2O$ | 51.6 |
| $K_2O$ | 75.1 |

Examples 3 through 6 present results from tests employing the process of the present invention.

EXAMPLE 3

Good removal of alkaline earth and alkali metal compounds occurred in Test 4 in which a −28 mesh subbituminous coal was leached for 2 hours with a relatively weak mixed acid, 6% HF and 15% HCl, at ambient temperature and 30% solids. Results are presented in Table 3.

TABLE 3

| Impurities, expressed as oxides | Impurity Extractions Test 4, 6% HF |
|---|---|
| Alkaline earths | |
| CaO | 98.1 |
| MgO | 94.7 |
| Alkali metals | |
| $Na_2O$ | 97.9 |
| $K_2O$ | 90.3 |

These superior results were totally unexpected. The expectation of those skilled in the art, prior to this invention, would be that an increase in the concentration of HF was needed to more effectively remove impurities from a coal feed.

EXAMPLE 4

In Test 5, a subbituminous coal from Alaska was leached for 2 hours in 2% HF, 11% $H_2SiF_6$ and 15% HCl at ambient temperature and 30% solids. The amount of fluoride which would be required to form complexes with the various cations arising from the dissolution of mineral impurities in the feed for Test 5 is shown in Table 4.

TABLE 4

| Fluoride Complexing Cations - expressed as oxides | Amount of fluorine required to form complexes (grams) |
|---|---|
| $SiO_2$ | 3.437 |
| $Al_2O_3$ | 2.758 |

TABLE 4-continued

| Fluoride Complexing Cations - expressed as oxides | Amount of fluorine required to form complexes (grams) |
|---|---|
| Total | 6.195 grams |

There were, however, only 4.425 grams of fluoride ion available in the leach of Test 5; therefore, no free fluoride ion was available to form insoluble precipitates.

The removal of alkaline earth and alkali metal compounds is shown in Table 5.

TABLE 5

| Impurities, expressed as oxides | Impurity Extractions Test 5, 2% HF |
|---|---|
| Alkaline earths | |
| CaO | 87.8 |
| MgO | 94.1 |
| Alkali metals | |
| $Na_2O$ | 87.9 |
| $K_2O$ | 70.7 |

These good extractions, with alkaline earth extractions considerable above what is possible even using 40% HF (see Test 1), occurred with leach liquor containing only 2% HF. Also, the presence of 11% fluorosilicic acid, which contained 20.28 grams of fluorine, did not impair the removal of alkaline earth and alkali metal compounds because the 20.28 grams of fluorine in the fluorosilicic acid was tightly bound with silicon as the $SiF_6^{2-}$ ion.

EXAMPLE 6

Tests 6 and 7 provide a comparison between two tests performed on a −28 mesh subbituminous coal containing significant amounts of alkaline earth and alkali metal impurities. Each test simulates the entire cleaning process including gravity separation. The first of these (Test 6) illustrates a prior art method. It employs an HCl pre-leach, which, prior to the present invention, was the preferred method for removing alkaline earth and alkali metal compounds. The second (Test 7) employs the leach of the present invention, simulating a preferred embodiment in which the leach liquor from the first leach derives from the second leach, and only one acid regeneration circuit is required. A summary of the processing steps and mineral extractions is given in Table 6. Both tests were conducted at ambient temperatures and 30% solids.

TABLE 6

| | Processing Conditions | |
|---|---|---|
| Step | Test 6 | Test 7 |
| 1 | Leach; 10% HCl; 2 hr. | Gravity Separation |
| 2 | Leach; 20% HF/15% HCl; 4 hr. | Leach; 2% HF/11% $H_2SiF_6$/15% HCl; 2 hr. |
| 3 | Gravity Separation | Leach; 20% HF/15% HCl; 4 hr. |

Extractions of certain alkaline earths, alkali metals and certain other impurities are shown in Table 7.

TABLE 7

| Extraction of Impurities (expressed as oxides) in Percent | | |
|---|---|---|
| Oxide | Test 6 | Test 7 |
| CaO | 97.3 | 93.3 |
| MgO | 95.0 | 98.9 |
| $Na_2O$ | 95.4 | 98.9 |

TABLE 7-continued

| Extraction of Impurities (expressed as oxides) in Percent | | |
|---|---|---|
| Oxide | Test 6 | Test 7 |
| $K_2O$ | 97.4 | 98.7 |
| $SiO_2$ | 98.9 | 99.3 |
| $Al_2O_3$ | 96.4 | 96.8 |
| $TiO_2$ | 83.2 | 81.4 |
| $Fe_2O_3$ | 96.4 | 96.1 |

The leaches of Test 7, employing the method of the present invention, removed the alkaline earth and alkali metal impurities more efficaciously than the leaches of Test 6, employing a prior art method, with the exception of removal of calcium. This diminished extraction of calcium in Test 7 is ascribed to the fact that, in Test 7, after the leach liquor was filtered away from the solids of the first (free-fluoride-ion kill) leach, the solids were rinsed with dilute (pH 1) HF. This rinse would of course contact free-fluoride-ions with the leach liquor entrapped with the solids, and because this entrapped leach liquor contains calcium ions, calcium fluoride would precipitate and affect the calculation of the degree of calcium extraction.

Extractions of certain other impurities ($SiO_2$, $Al_2O_3$, $TiO_2$ and $Fe_2O_3$) are shown in Table 7 to illustrate that the leach of the present invention is technically as good as or better than the prior art leach methods. Since the leach of the present invention is much more economical than that of the prior art methods, the present invention allows practical chemical cleaning of the vast tonnage of subbituminous coal reserves held by this nation as well as providing an improved method for reducing alkaline earth and alkali metal impurities in all coals to the low levels required for combustion, especially in heat engines (diesel engines and gas turbines).

Although the foregoing invention has been described in detail and by way of example for purposes of clarity and understanding, as will be known and understood by those skilled in the art, changes and modifications may be made without departing from the spirit of the invention which is limited only by the appended claims.

What is claimed is:

1. A method for substantially reducing the amount of at least one insoluble fluoride-forming species selected from the group consisting of Group IA species and Group IIA species, said species being present in a coal feed material comprising:

forming a slurry of a coal feed;

a fluoride acid in an amount to produce a first molar concentration of free-fluoride-ions;

at least one fluoride-complexing species, the total of all fluoride-complexing species in said slurry being present in an amount to produce a second molar concentration, said second molar concentration being at least equal to that amount such that the ratio of said first molar concentration to said second molar concentration is substantially equal to the stoichiometric ratio of fluoride in at least one tightly-bound complex ion so as to form tightly-bound complexions with substantially all free-fluoride-ions in the slurry to produce a leached coal product and a spent leach liquor; and separating said leached coal product from said spent leach liquor.

2. The process of claim 1 further comprising:

leaching said separated leached coal product with a strong acid leach liquor to produce strong acid-leached solids and a spent strong acid leach liquor.

3. The process of claim 2 wherein said strong acid-leached solids contain pyrite and volatile halides and further comprising:

removing a substantial portion of said halides; and physically separating a substantial portion of said pyrite from the remainder of said strong acid-leached solids to produce a reduced ash coal product.

4. The process of claim 3 wherein said reduced ash coal product has an ash-precursor content of less than about 0.2 percent by weight.

5. The process of claim 2 further comprising:

recycling said spent strong acid leach liquor to said slurry.

6. The process of claim 1 further comprising:

regenerating acid from said spent leach liquor.

7. The process of claim 6, further comprising:

advancing said regenerated acid to a strong acid leaching step.

8. The process of claim 1 wherein said slurry further comprises HCl.

9. The process of claim 1 wherein said fluoride-complexing species comprises material selected from the group consisting of Si and Al.

10. The process of claim 1 wherein said coal feed material contains alkaline earths and alkali metals and wherein substantially all alkaline earths and alkali metals available in said coal are in said spent leach liquor at equilibrium.

11. The process of claim 1 wherein said insoluble fluoride-forming species is calcium.

12. In a process for cleaning coal feed comprising a strong acid leach to remove ash-precursors therefrom, the improvement comprising:

pre-leaching said coal feed with a pre-leach comprising a fluoride acid present in an amount to produce a first molar concentration of free-fluoride-ions containing one or more fluoride-complexing species in an amount to produce a second molar concentration, the ratio of said first molar concentration to said second molar concentration being sufficiently small that at equilibrium at least some solid oxide of said fluoride-complexing species precipitates, to produce pre-leached solids, a solid oxide of said species and spent pre-leach liquor;

separating said pre-leached solids and solid oxide from said spent pre-leach liquor;

forwarding said pre-leached solids to said strong acid leach to produce strong acid-leached solids and spent strong acid leach liquor.

13. The process of claim 12 wherein said fluoride acid comprises HF.

14. The process of claim 12 wherein said fluoride-complexing species is selected from the group consisting of Si and Al.

15. The process of claim 12 wherein said coal feed comprises low rank coal.

16. The process of claim 12 wherein said strong acid leach is conducted with a leach liquor comprising HF.

17. The process of claim 12 further comprising regenerating acid from said spent strong acid leach liquor.

18. The process of claim 12 wherein said strong acid leach is conducted with a leach liquor comprising concentrated spent strong acid leach liquor.

19. The process of claim 12 wherein said fluoride-complexing species comprises Si in an amount sufficient to complex substantially all free-fluoride-ions present in the pre-leach as $SiF_6^{-2}$.

20. The process of claim 12 wherein said fluoride-complexing species comprises Al in an amount sufficient to complex substantially all free-fluoride-ions present in the pre-leach as $AlF_6^{-3}$.

21. The process of claim 12 wherein Al and Si are said fluoride-complexing species and are present in an amount sufficient to form $Al_2O_3$ or $SiO_2$ at equilibrium conditions.

22. A process for cleaning a coal feed comprising:

(a) leaching said coal feed in a leach comprising a fluoride acid present in an amount to produce a first molar concentration of free-fluoride-ions and at least one fluoride-complexing species, the total of all fluoride-complexing species in said slurry being present in an amount to produce a second molar concentration, said second molar concentration being at least equal to that amount such that the ratio of said first molar concentration to said second molar concentration is substantially equal to the stoichiometric ratio of fluoride in at least one tightly-bound complex ion to preclude precipitation of appreciable amounts of insoluble alkali metal fluorides and alkaline earth fluorides at equilibrium to produce a spent first leach liquor and a first leach residue substantially depleted of alkali and alkaline earth metals; and (b) separating said first leach liquor from said first residue.

23. The process of claim 22 further comprising:

(c) leaching said first residue in a strong halogen acid leach.

24. A process according to claim 23 further comprising regenerating the fluoride acid from the spent first liquor of step (b) for use in the leach of step (c).

25. A process according to claim 23 further comprising recycling at least a portion of the spent leach liquor of step (c) to the leach of step (a).

26. A process according to claim 23 further comprising regenerating halogen acid from the spent liquor of step (c) for use in the leach of step (c).

27. A process for removing insoluble fluoride-forming species selected from the group consisting of fluorides of Group IA and fluorides of Group IIA from a coal feed comprising:

(a) leaching said feed with a fluoride acid present in an amount to produce a first molar concentration of free-fluoride-ions and one or more fluoride-complexing species present in an amount to produce a second molar concentration, the ratio of said first molar concentration to said second molar concentration being sufficiently small that at equilibrium at least some solid oxide of said fluoride-complexing species precipitates,; and (b) separating the leached feed from the spent acid.

28. A process according to claim 27 further comprising:

(c) leaching said leach feed with a strong halogen acid.

* * * * *